US011305202B2

(12) United States Patent
Vance et al.

(10) Patent No.: US 11,305,202 B2
(45) Date of Patent: Apr. 19, 2022

(54) TRACK RAIL ACQUISITION, CARRYING, AND TRANSFER SYSTEMS AND METHODS

(71) Applicant: Universal City Studios LLC, Universal City, CA (US)

(72) Inventors: Eric Alan Vance, Orlando, FL (US); Clarisse Marie Vamos, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 389 days.

(21) Appl. No.: 16/368,554

(22) Filed: Mar. 28, 2019

(65) Prior Publication Data

US 2020/0122045 A1 Apr. 23, 2020

Related U.S. Application Data

(60) Provisional application No. 62/748,931, filed on Oct. 22, 2018.

(51) Int. Cl.
*A63G 31/02* (2006.01)
*A63G 31/00* (2006.01)

(52) U.S. Cl.
CPC ..... *A63G 31/02* (2013.01)

(58) Field of Classification Search
CPC ..... A63G 7/00; A63G 31/00; A63G 31/16; A63G 21/00; A63G 21/04; A63G 21/20; A63H 18/02; A63H 18/08
USPC ..... 472/43, 59, 60, 130; 104/53
See application file for complete search history.

(56) References Cited

U.S. PATENT DOCUMENTS

| | | | | |
|---|---|---|---|---|
| 5,893,802 | A | 4/1999 | Bohme | |
| 6,308,818 | B1 | 10/2001 | Bonora et al. | |
| 6,341,564 | B1 | 1/2002 | Ochi | |
| 6,755,749 | B2 | 6/2004 | Stengel | |
| 7,371,182 | B2 | 5/2008 | Henry et al. | |
| 8,057,317 | B2 | 11/2011 | Roodenburg et al. | |
| 8,641,540 | B2 | 2/2014 | Feuer et al. | |
| 8,801,492 | B2 * | 8/2014 | O'Connor | A63H 18/02 446/444 |
| 8,943,975 | B2 | 2/2015 | Gmeinwieser et al. | |

(Continued)

FOREIGN PATENT DOCUMENTS

| | | |
|---|---|---|
| CN | 103505878 | 1/2014 |
| WO | 9622821 | 8/1996 |

OTHER PUBLICATIONS

PCT/US2019/053985 International Search Report and Written Opinion dated Jan. 13, 2020.

(Continued)

*Primary Examiner* — Kien T Nguyen
(74) *Attorney, Agent, or Firm* — Fletcher Yoder P.C.

(57) ABSTRACT

Provided herein are systems that include bogie systems configured to travel along track members that define a ride path, to detach certain track members from adjacent track members, and to re-attach the detached track members to other track members that may not be orthogonal or coplanar. By employing the embodiments described herein, the system may be able to seamlessly change the direction of travel of a ride vehicle from a lateral direction to a longitudinal direction, from a lateral direction to a vertical direction, or from a vertical direction to the longitudinal direction, to name but a few.

20 Claims, 16 Drawing Sheets

(56) References Cited

U.S. PATENT DOCUMENTS

| | | | | |
|---|---|---|---|---|
| 9,457,282 | B2 * | 10/2016 | Maycock | A63G 7/00 |
| 9,486,135 | B1 | 11/2016 | Fram | |
| 9,839,856 | B2 * | 12/2017 | Crawford | A63G 7/00 |
| 2006/0230974 | A1 * | 10/2006 | Murray | A63H 18/04 104/53 |
| 2006/0286897 | A1 * | 12/2006 | Bedford | A63H 18/08 446/444 |
| 2007/0074638 | A1 | 4/2007 | Blum et al. | |
| 2012/0164914 | A1 * | 6/2012 | O'Connor | A63H 18/02 446/444 |
| 2016/0257316 | A1 | 9/2016 | Rupp et al. | |
| 2016/0346704 | A1 * | 12/2016 | Wagner | G06T 19/006 |
| 2017/0043791 | A1 | 2/2017 | Briggs et al. | |
| 2017/0197642 | A1 | 7/2017 | Rupp et al. | |
| 2019/0388793 | A1 * | 12/2019 | McVeen | B61B 15/00 |

OTHER PUBLICATIONS

Jagolinzer, Scott; "Trackless Multi-Dimensional Ride Vehicle," Tech Briefs Create the Future Design Contest, May 13, 2015, https://contest.techbriefs.com/2015/entries/automotive-transportation/5347.

* cited by examiner

TRACK RAIL ACQUISITION, CARRYING, AND TRANSFER SYSTEMS AND METHODS

CROSS-REFERENCE TO RELATED APPLICATION

This application claims priority to and the benefit of U.S. Provisional Application No. 62/748,931, entitled "Track Rail Acquisition, Carrying, and Transfer Systems and Methods," filed Oct. 22, 2018, which is hereby incorporated by reference in its entirety for all purposes.

BACKGROUND

The present disclosure relates generally to amusement park-style rides and, more specifically, to systems for controlling motion of a ride vehicle of the amusement park-style rides.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Generally, amusement park-style rides include ride vehicles that carry passengers along a ride path, for example, defined by a track. Over the course of the ride, the ride path may include a number of features, including tunnels, turns, ascents, descents, loops, and so forth. The direction of travel of the ride vehicle may be defined by the ride path, as rollers of the ride vehicle may be in constant contact with the tracks defining the ride path. In this manner, executing turns may require a ride vehicle to traverse along the ride path in a motion having a substantially large turning radius, often to control the centripetal acceleration associated with performing such conventional turns. Further, ride passengers may anticipate these conventional turns, reducing excitement and thrill associated with amusement park-style rides. Accordingly, it may be desirable to perform unconventional turns, such as turns with little to no turning radii, in certain motion-based amusement park-style rides, for example, to enhance the excitement and thrill of the ride experience, the implementation of which may be difficult to coordinate in practice.

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible forms of the subject matter. Indeed, the subject matter may encompass a variety of forms that may be similar to or different from the embodiments set forth below.

In accordance with one embodiment, an apparatus of an amusement park includes a bogie system configured to be positioned on a track that includes a plurality of track members that define a ride path. The bogie system includes one or more bogies, each bogie including a track engagement mechanism configured to facilitate motion of the bogie along the plurality of track members, to detach one or more track members of the plurality of track members from the track, to move the one or more track members relative to the track, and to attach the one or more track members to the track.

In accordance with another embodiment, an amusement park track system includes a plurality of track members that define a ride path. The plurality of track members includes a first set of stationary track members that remain fixed relative to the ride path. The plurality of track members also includes a second set of moveable track members configured to be detached from the first set of stationary track members, to be moved relative to the first set of stationary track members, and to be attached to the first set of stationary track members.

In accordance with another embodiment, a method includes detaching a first track member of an amusement park track system from a second track member of the amusement park track system using a bogie system. The method also includes moving the first track member relative to the amusement park track system using the bogie system. The method further includes attaching the first track member to a third track member of the amusement park track system using the bogie system.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
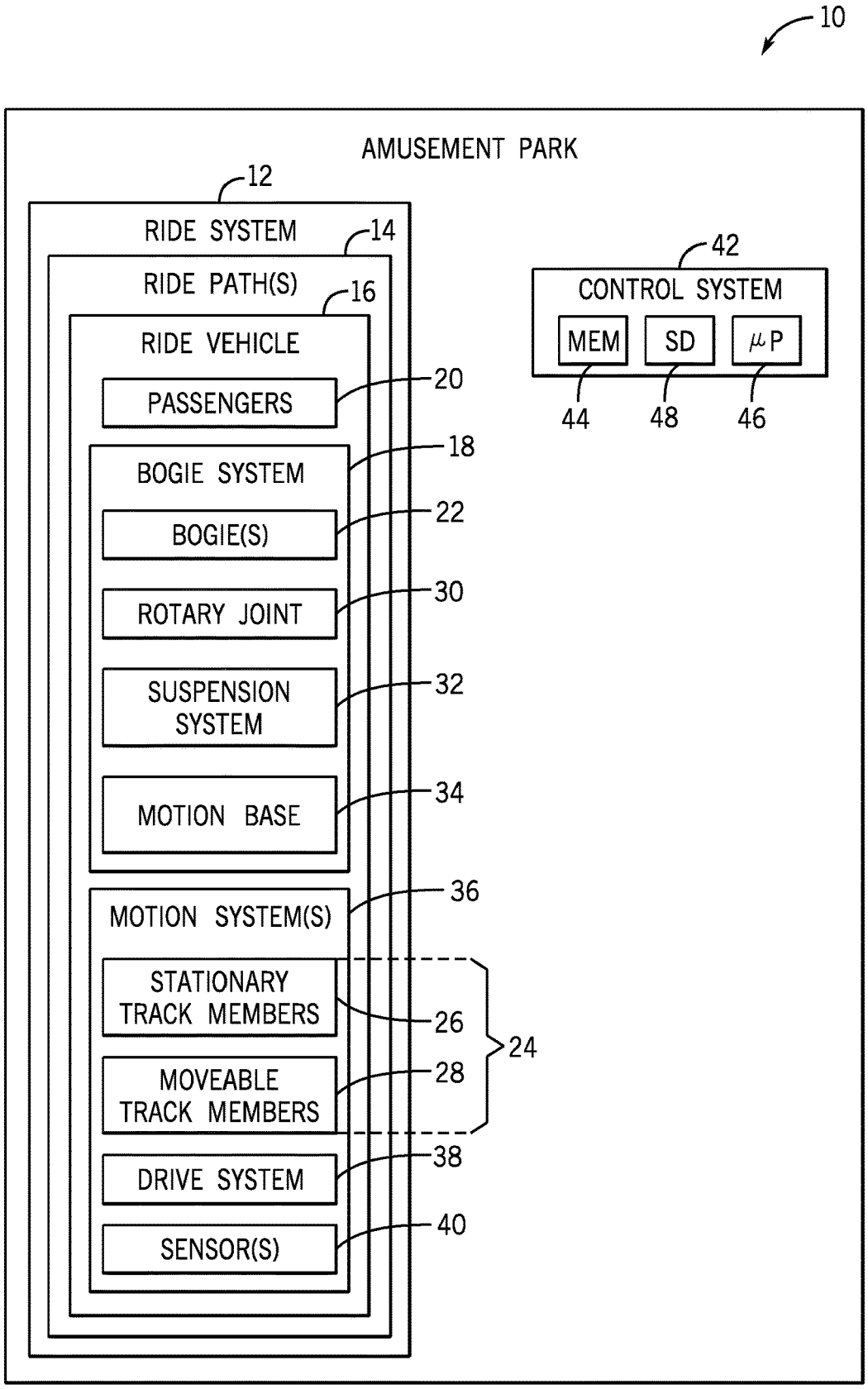
FIG. 1 is a block diagram of an embodiment of various components of an amusement park, in accordance with aspects of the present disclosure.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

While the following discussion is generally provided in the context of amusement park-style rides, it should be understood that the embodiments described herein are not limited to such entertainment contexts. Indeed, the provision of examples and explanations in such an entertainment application is to facilitate explanation by providing instances of real-world implementations and applications. It should be appreciated that the embodiments described herein may be useful in other applications, such as transportation systems (e.g., train systems), conveyer line systems, distribution systems, logistics systems, automation dynamic systems, and/or other industrial, commercial, and/or recreational systems, to name but a few.

For example, amusement park-style rides may employ ride vehicles that carry passengers along a ride path, for example, defined by a track. Over the course of the ride, the ride path may include a number of features, including tunnels, turns, ascents, descents, loops, and so forth. The direction of travel of the ride vehicle may be defined by the ride path, as the ride vehicle (e.g., via a bogie system) may be in constant contact with the track members of the track defining the ride path. In this manner, performing turns may require a ride vehicle to traverse along the ride path in a motion having a substantially large turning radius to control the centripetal acceleration associated with performing such turns. Further, ride passengers may anticipate these turns, eliminating excitement and thrill typically associated with amusement park-style rides. Accordingly, it may be desirable to perform unconventional turns, such as turns with little to no turning radii, in certain motion-based amusement park-style rides, for example, to enhance the excitement and thrill of the ride experience. However, causing the ride vehicle to execute certain unconventional turns, such as 90 degree turns (e.g., turns with a small turning radius or no turning radius), while traveling along the ride path, may be difficult to implement in practice.

With the foregoing in mind, by using the systems and methods described herein, the ride experience may be enhanced. In certain embodiments, a system includes bogie systems configured to travel along track members that define a ride path, to detach certain track members from adjacent track members, and to re-attach the detached track members to other track members that may not be orthogonal or coplanar. By employing the embodiments described herein, the system may be able to seamlessly change the direction of travel of a ride vehicle from a lateral direction to a longitudinal direction, from a lateral direction to a vertical direction, or from a vertical direction to the longitudinal direction, to name but a few.

To help illustrate, FIG. 1 is a block diagram of an embodiment of various components of an amusement park 10, in accordance with aspects of the present disclosure. The amusement park 10 may include a ride system 12, which includes a ride path 14 that receives and guides a ride vehicle 16, such as by engaging with a bogie system 18 associated with the ride vehicle 16, and facilitates movement of the ride vehicle 16 along the ride path 14. In this manner, the ride path 14 may define a trajectory and direction of travel that may include turns, inclines, declines, ascents, descents, banks, loops, and the like. In certain embodiments, the ride vehicle 16 may be passively driven or actively driven via a pneumatic system, a motor system, a tire drive system, fins coupled to an electromagnetic drive system, a catapult system, and the like. In certain embodiments, the ride vehicle 16 may include a cabin, a cage, a coaster-like structure, a platform, and so forth. Indeed, although described herein as being a ride vehicle 16 having, for example, seating for passengers 20, in other embodiments, the ride vehicle 16 may instead, or in addition to, include a structure that includes show equipment. In certain embodiments, the bogie system 18 may support a motor, a pneumatic driving system, an electrical system, and so forth. The bogie system 18 may be configured to support the load of various components of the ride vehicle 16 and the passengers 20 and/or various components of show equipment. Such components may include, for example, lighting features, audio features, special effects features (e.g., leg ticklers, and so forth), or any combination thereof.

The ride vehicle 16 may be configured to physically couple to a bogie system 18. For example, in certain embodiments, the bogie system 18 is configured to receive the ride vehicle 16 and to secure the ride vehicle 16 to the bogie system 18. As described in greater detail herein, the bogie system 18 may include one or more bogies 22 that are configured to directly interact with a track system 24 that defines the ride path 14. For example, in certain embodiments, the bogies 22 are configured to directly interact with multiple track members 26, 28 of the track system 24 that guide travel of the bogie system 18 and the ride vehicle 16 along the ride path 14. As described in greater detail herein, the track members 26, 28 of the track system 24 may include a first set of track members 26 that generally remain in a fixed position (i.e., stationary) relative to the ride path 14, and a second set of track members 28 that are configured to be removably coupled to the first set of track members 26 such that each of the second set of track members 28 may be detached from an adjacent track member 26 of the first set of track members 26 by the bogies 22 of the bogie system 18, transported to a new location relative to the ride path 14, and attached to a new track member 26 of the first set of track members 26.

In addition, in certain embodiments, the bogie system 18 may include one or more rotary joints 30 coupled to, and disposed between, bogies 22 of the bogie system 18 such that each rotary joint 30 facilitates rotation of the bogies 22 relative to each other. In general, the rotary joint 30 is configured to orient the bogies 22 of the bogie system 18 with track members 26, 28 along which the bogie system 18 travels. In certain embodiments, the bogie system 18 may include more than two bogies 22 with each set of adjacent bogies 22 separated by a respective rotary joint 30 such that relatively complex orientations between the plurality of bogies 22 may be achieved.

In certain embodiments, the bogie system 18 may include a suspension system 32, which may dampen motion or vibrations while the ride vehicle 16 is in operation, for example, by absorbing vibration and reducing centrifugal forces when the ride vehicle 16 executes certain motions, such as turns, at certain velocities. The suspension system 32 may be actuated to enhance the ride experience for passengers 20, for example, by stiffening, vibrating, or rotating components of the suspension system 32.

Furthermore, in certain embodiments, the bogie system 18 may include a motion base 34 positioned between the bogies 22 and the ride vehicle 16. In certain embodiments, the motion base 34 may enable the ride vehicle 16 to move relative to the bogie system 18 in any suitable direction. To this end, the motion base 34 may enable the ride vehicle 16 to rotate about or vibrate along a yaw axis, a pitch axis, or a roll axis. In this manner, the motion base 34 may enable six degrees-of-freedom motion of the ride vehicle 16 relative to the bogie system 18. In certain embodiments, the ride vehicle 16 may include an orientation sensor, such as a gyroscope and/or accelerometer, configured to provide feedback for use (e.g., by a control system) in determining motion of the ride vehicle 16, such as linear motion along three orthogonal axes, and the roll, pitch, and yaw of the ride vehicle 16.

The ride path 14 may include a motion system 36, as described in greater detail herein. The motion system 36 may include the sets of track members 26, 28 and a drive system 38. The track members 26, 28 may be positioned along the ride path 14 and include substantially similar dimensions (e.g., cross sectional area) such that the ride vehicle 16 may seamlessly transition along the ride path 14 via the track members 26, 28. In other words, the track members 26, 28 are components of the ride system 12 that at least partially define the ride path 14. In certain embodiments, one or more of the track members 26, 28 may be coupled to one or more corresponding drive systems 38. For example, the drive system 38 may include a motor, gear assembly, electromechanical or pneumatic actuator, or any combination thereof, configured to facilitate motion of the ride vehicle 16 as it moves relative to the ride path 14.

In certain embodiments, one or more of the track members 26, 28 may include a stopping device, such as a dead end stopping pin or any suitable device (e.g., compliant material, in certain embodiments) configured to decelerate the ride vehicle 16 to enable the ride vehicle 16 to stop at a target position on one or more of the track members 26, 28. For example, the stopping device may be configured to limit rotation of the ride vehicle 16 relative to the track members 26, 28, thereby rendering the ride vehicle 16 stationary relative to the track members 26, 28.

In certain embodiments, the motion system 36 may include one or more sensor assemblies 40 configured to provide feedback indicative of a position, velocity, and/or acceleration of the ride vehicle 16 relative to the ride path 14. For example, in certain embodiments, the sensor assemblies 40 may include infrared sensors positioned along the ride path 14 to determine the position, velocity, and/or acceleration of the ride vehicle 16 along the ride path 14. In this manner, the sensor assemblies 40 may be used to confirm that the ride vehicle 16 is in a desired or target position on or relative to one or more of the track members 26, 28. For example, in certain embodiments, the sensor assemblies 40 may be communicatively coupled to a control system 42, and the control system 42 may be configured to control operation of the various components of the ride system 12 based at least in part on the operating parameters detected by the one or more sensor assemblies 40, as described in greater detail herein. For example, in certain embodiments, the sensor assemblies 40 may be configured to detect position, velocity, and/or acceleration of the bogie system 18, and the control system 42 may be configured to control operation of the drive system 38 and/or the bogie system 18 based at least in part on the detected position, velocity, and/or acceleration of the bogie system 18. In addition, in certain embodiments, the sensor assemblies 40 may include one or more sensors positioned on one or more of the track members 26, 28 to determine when the bogie system 18 reaches certain positions on the track member 26, 28, such that when the bogie system 18 reaches certain points along the track member 26, 28, the drive system 38 and/or the bogie system 18 may be appropriately controlled by the control system 42.

In general, the control system 42 may be communicatively coupled (e.g., via wired or wireless features) to the ride vehicle 16 and the other components of the ride path 14. In certain embodiments, the amusement park 10 may include more than one control system 42. For example, in certain embodiments, the amusement park 10 may include one control system 42 associated with the ride vehicle 16, another control system 42 associated with the motion system 36, and so forth, such that each of the control systems 42 are communicatively coupled to one another (e.g., via respective transceiver or wired connections).

The control system 42 may be communicatively coupled to one or more ride vehicle(s) 16 of the amusement park 10 via any suitable wired and/or wireless connection (e.g., via transceivers). As described herein, the control system 42 may control various aspects of the ride system 12, such as the direction of travel of the ride vehicle 16, in some portions of the ride path 14 by actuating the motion system 36 to drive motion of the ride vehicle 16. For example, the control system 42 may receive data from the sensor assemblies 40 to, for example, control operation of the motion system 36. In certain embodiments, the control system 42 may be an electronic controller having electrical circuitry configured to process data associated with the ride vehicle 16, for example, from the one or more sensor assemblies 40 via the transceivers. Furthermore, in certain embodiments, the control system 42 may be coupled to various components of the amusement park 10 (e.g., park attractions, park controllers, and wireless networks).

The control system 42 may include a memory device 44 and a processor 46, such as a microprocessor. The control system 42 may also include one or more storage devices 48 and/or other suitable components. The processor 46 may be used to execute software, such as software for controlling the ride vehicle(s) 16 and any of the other components associated with the ride vehicle 16 along the ride path 14 (e.g., the motion system 36, the bogie system 18, and so forth). Moreover, in certain embodiments, the processor 46 may include multiple microprocessors, one or more "general-purpose" microprocessors, one or more special-purpose microprocessors, and/or one or more application-specific integrated circuits (ASICs), or some combination thereof. For example, in certain embodiments, the processor 46 may include one or more reduced instruction set (RISC) processors.

The memory device 44 may include a volatile memory, such as random-access memory (RAM), and/or a nonvolatile memory, such as read-only memory (ROM). The memory device 44 may store a variety of information and may be used for various purposes. For example, the memory device 44 may store processor-executable instructions (e.g., firmware or software) for the processor 46 to execute, such as instructions for controlling components of the ride vehicle 16, the motion system 36, the bogie system 18, and so forth.

The storage device(s) 48 (e.g., nonvolatile storage) may include ROM, flash memory, a hard drive, or any other suitable optical, magnetic, or solid-state storage medium, or a combination thereof. The storage device(s) 48 may store data (e.g., passenger information, data associated with the amusement park 10, data associated with a trajectory of the ride path 14, and so forth), instructions (e.g., software or firmware for controlling the bogie system 18, the motion system 36, the ride vehicle 16, and so forth), and any other suitable information.

Figure 2:
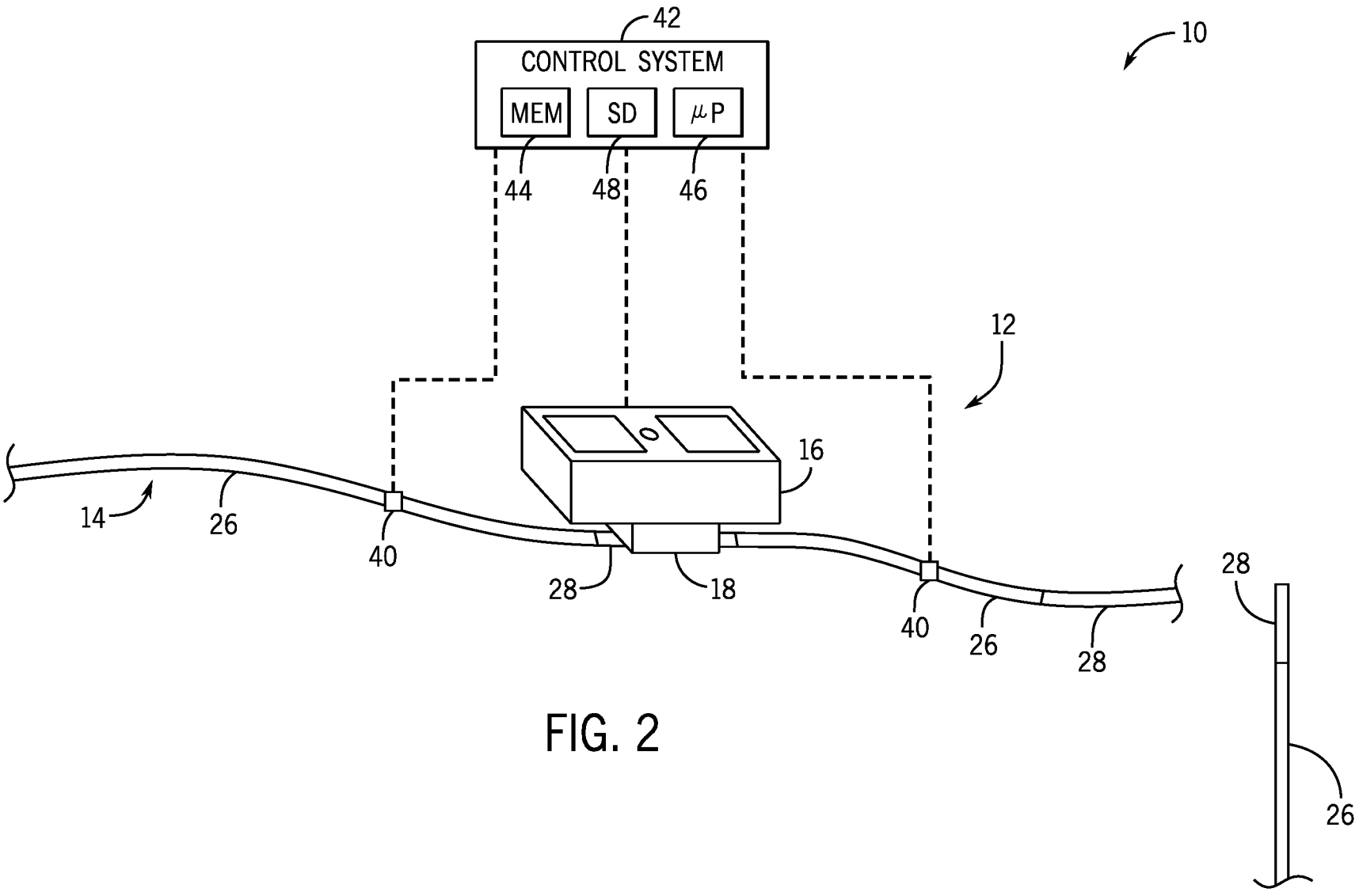
FIG. 2 is a schematic diagram of an embodiment a ride system, in accordance with aspects of the present disclosure.

FIG. 2 is a schematic diagram of an embodiment of the ride system 12, in accordance with aspects of the present disclosure. The ride path 14 may include any features that define the direction of travel of the ride vehicle 16. As described in greater detail herein, the control system 42 may instruct the ride vehicles 16 to travel along the ride path 14 in any desired manner. For example, the control system 42 may control the movement (e.g., direction, speed, and/or orientation) of the ride vehicle 16 as it progresses along the ride path 14. In certain embodiments, the control system 42 may enable the ride vehicle 16 to execute a number of substantially ninety degree turns (e.g., without adjusting an orientation of the ride vehicle 16) having a reduced turning radius, as described in detail herein.

Figure 3:
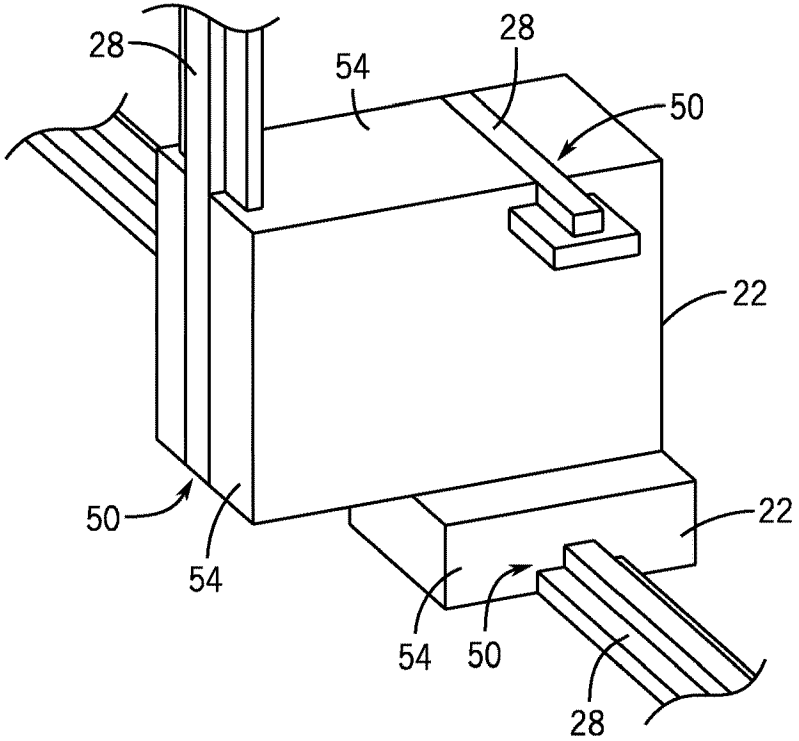
FIG. 3 is a perspective view of an embodiment of a bogie system, in accordance with aspects of the present disclosure.

FIG. 3 is a perspective view of an embodiment of a bogie system 18, in accordance with aspects of the present disclosure. As illustrated in FIG. 3, in certain embodiments, the bogie system 18 may include two bogies 22 coupled to each other via a rotary joint 30 (see, e.g., FIG. 15) that facilitates rotation of the two bogies 22 with respect to each other. Although illustrated in FIG. 3, and described herein, as having two bogies 22, in other embodiments, the bogie system 18 may instead include more than two bogies 22 with each of the bogies 22 being separated from an adjacent bogie 22 by a respective rotary joint 30. Such embodiments would provide even more degrees of freedom with respect to the bogies 22 of the bogie system 18. As described herein, in certain embodiments, a ride vehicle 16 (and/or other amusement park related features, such as show equipment) may be coupled to one of the bogies 22 of the bogie system 18 such that the bogie system 18 facilitates movement of the ride vehicle 16 along a ride path 14 defined by a plurality of track members 26, 28.

In particular, as illustrated in FIG. 3, in certain embodiments, each of the bogies 22 of the bogie system 18 may include a track engagement mechanism 50 configured to facilitate motion of the bogie 22 along the track members 26, 28. For example, as illustrated in FIG. 3, the track engagement mechanisms 50 may have a shape configured to mate with a corresponding shape of the track members 26, 28. Although illustrated in FIG. 3 as being a groove disposed on a side 54 of the bogie 22, which is configured to mate with track members 26, 28 having corresponding shapes, the track engagement mechanisms 50 of the bogies 22 may take different forms in other embodiments, such as one or more bores that extend through the bogie 22, as described in greater detail herein.

Figure 4:
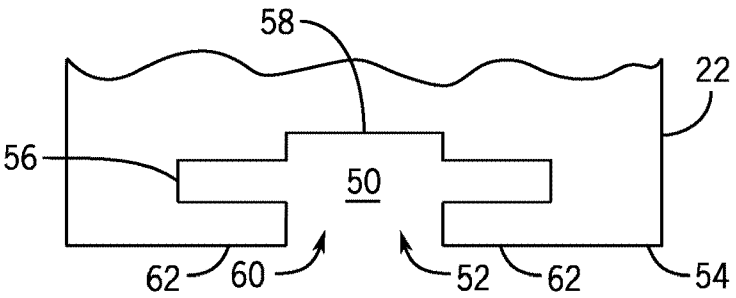
FIG. 4 is a partial cross-sectional view of bogies illustrated in FIG. 3 to illustrate the shape of track engagement mechanisms of the bogies, in accordance with aspects of the present disclosure.

For example, FIG. 4 is a partial cross-sectional view of the bogies 22 illustrated in FIG. 3 to illustrate the shape of the track engagement mechanisms 50 of the bogies 22, in accordance with aspects of the present disclosure. As illustrated in FIG. 4, in certain embodiments, the track engagement mechanisms 50 of the bogies 22 may have a cross-section where a groove 52 includes a primary rectangular section 56, a secondary (e.g., inset) section 58 on a first side of the primary rectangular section 56, and an opening 60 defined by two lips 62 on an opposite second side of the primary rectangular section 56. In certain embodiments, the secondary section 58 and the opening 60 may be similarly shaped such that the groove 52 of the bogies 22 may be configured to interact with the track members 26, 28 on either side of the track members 26, 28, which enables even more motion capabilities of the bogies 22 with respect to the track members 26, 28. Furthermore, it will be appreciated that the secondary section 58 and the opening 60 of the groove 52 of the track engagement mechanisms 50 of the bogies 22 may provide lateral stability for the bogies 22 with respect to the track members 26, 28.

Figure 5:
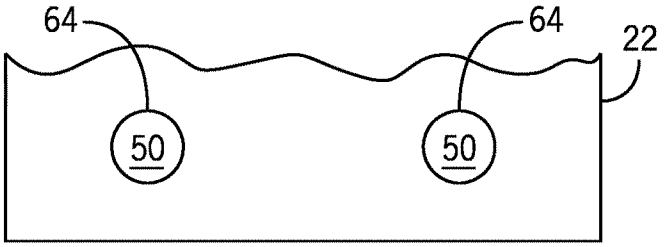
FIGS. 5 and 6 are partial cross-sectional views of other bogies to illustrate other shapes of track engagement mechanisms of the bogies, in accordance with aspects of the present disclosure.
Figure 6:
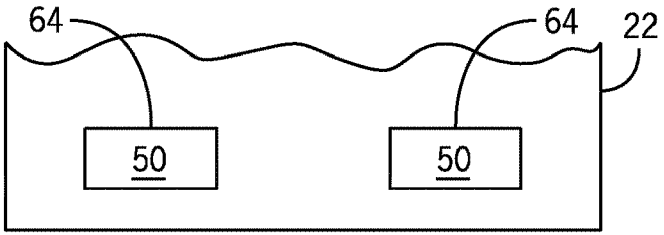

FIGS. 5 and 6 are partial cross-sectional views of other bogies 22 to illustrate other shapes of the track engagement mechanisms 50 of the bogies 22, in accordance with aspects of the present disclosure. In particular, as illustrated in FIGS. 5 and 6, in certain embodiments, the track engagement mechanisms 50 of the bogies 22 may have a cross-section having one or more bores 64 that extend all the way through the bogies 22. As illustrated in FIG. 5, in certain embodiments, the one or more bores 64 may be circular in shape. However, as illustrated in FIG. 6, in other embodiments, the one or more bores 64 may be rectangular in shape. Indeed, in yet other embodiments, the one or more bores 64 may have any suitable shape. In addition, although illustrated in FIGS. 5 and 6 as having two bores 64 extending through the bogies 22, in other embodiments, the track engagement mechanisms 50 of the bogies 22 may include more than two bores 64 that extend through the bogies 22.

As described in greater detail herein, in addition to facilitating motion of the bogie systems 18 along the ride path 14 defined by the track members 26, 28, the bogies 22 of the bogie systems 18 described herein are also configured to detach the second set of (moveable) track members 28 from the first set of (stationary) track members 26, to move the second set of (moveable) track members 28 relative to the first set of (stationary) track members 26, and to re-attach the second set of (moveable) track members 28 to the first set of (stationary) track members 26 at other locations.

FIGS. 7 through 14 illustrate a series of steps of a bogie system 18 traveling along a ride path 14 defined by the track members 26, 28, in accordance with aspects of the present disclosure. As illustrated in FIGS. 7 through 14, the track members 26, 28 may be disposed at various elevations and at any orientation relative to each other. For example, the track members 26, 28 do not have to be orthogonal or coplanar with each other. Rather, the bogie system 18 enables switching between the track members 26, 28 for any spatial relationship between the track members 26, 28. As also illustrated in FIGS. 7 through 14, each of the stationary track members 26 have gaps or finite ends to allow for insertion of the bogie system 18 onto the stationary track members 26. Furthermore, it will be appreciated that the track members 26, 28 enable bidirectional motion of the bogie system 18 at varying speeds and performance. In addition, the bogie system 18 may translate down track members 26, 28 that have rolls, twists, directional changes, and any other maneuvers typical roller coasters can achieve.

In certain embodiments, stationary transfer of the ride vehicle 16 (i.e., via the bogie system 18) between stationary track members 26 may occur. For example, in certain embodiments, the bogie system 18 (and the ride vehicle 16 coupled to the bogie system 18) may come to a complete stop with respect to a first stationary track member 26, reorient the bogies 22 of the bogie system 18 (as well as the ride vehicle 16, in certain embodiments), pick up or drop off a moveable track member 28, and then continue movement along a second stationary track member 26. Such transfers allow for non-parallel movement along the ride path 14 defined by the track members 26, 28. However, it should be noted that, in certain embodiments, the bogie system 18 may not come to a complete stop before the bogies 22 of the bogie system 18 are reoriented with respect to each other. Rather, in certain embodiments, one of the bogies 22 may reorient itself with respect to another bogie 22 in anticipation of an upcoming moveable track member 28 exchange point while still moving along a stationary track member 26. In doing so, the exchange of moveable track members 28 at the upcoming moveable track member 28 exchange point may be achieved without waiting for reorientation of the bogies 22 to occur once the bogie system 18 has come to a complete stop.

Alternatively, in certain situations, on-the-fly transfer between track members 26, 28 may occur (i.e., a running track transfer) using the same bogie system 18. This type of transfer generally includes parallel track members 26, 28, and includes the bogie system 18 leaving behind a moveable track member 28. In such embodiments, a second moveable track member 28 may not be picked up by the bogie system 18 when the first moveable track member 28 is left behind. In other words, in such embodiments, the bogie system 18 is not limited to 'take one, leave one' maneuvers. Indeed, in other embodiments, the bogie system 18 may pick up a moveable track member 28 without leaving another moveable track member 28 behind. For example, the grooves 52 within the bogies 22 of the bogie system 18 may engage with a stationary track member 26 without any moveable track member 28 so long as relatively significant track leeway is given, for example, to the ride vehicle 16 (and/or show equipment, in certain embodiments) to confirm proper orientation prior to engagement.

Figure 7:
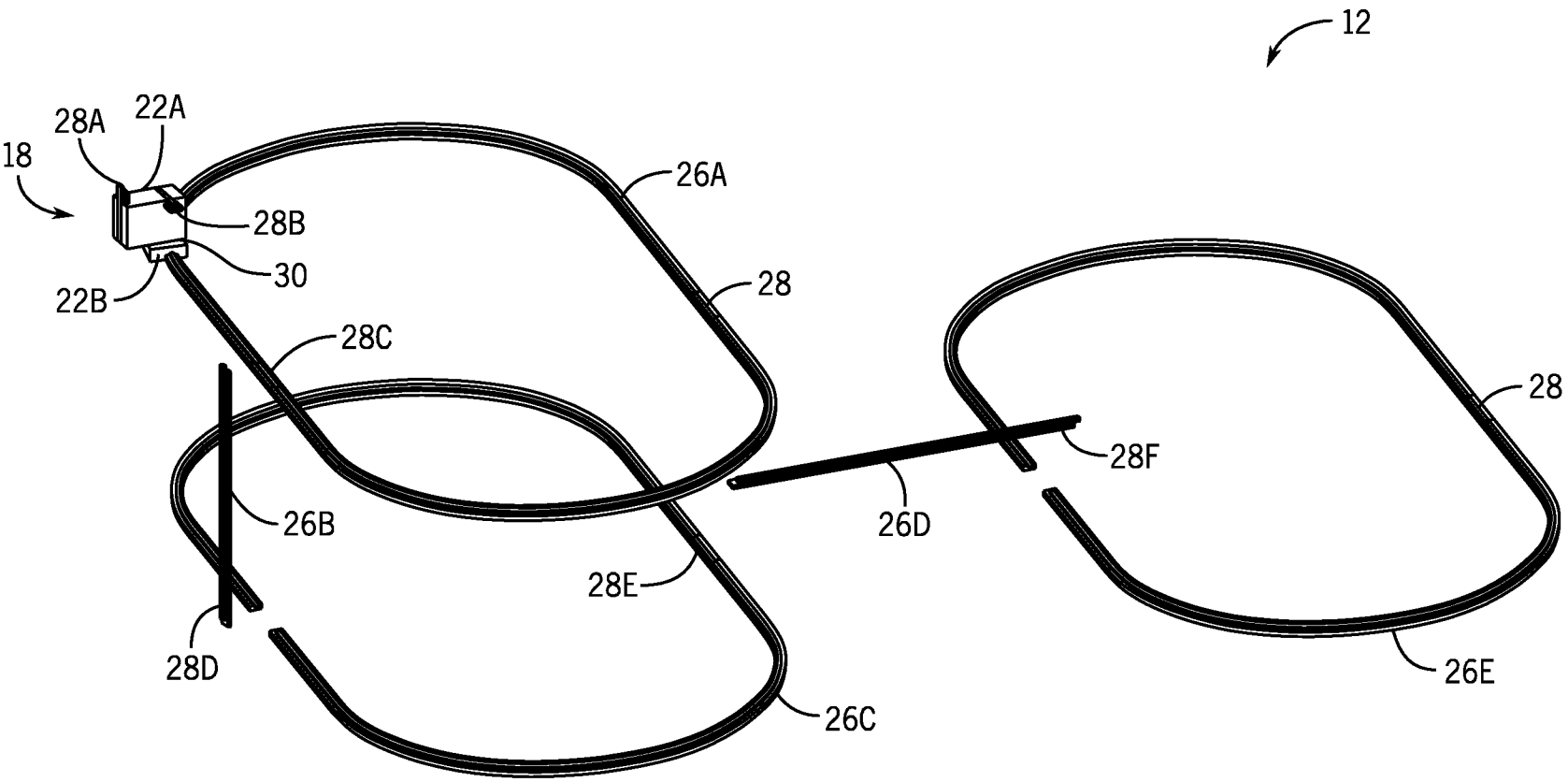
FIGS. 7 through 14 illustrate a series of steps of a bogie system traveling along a ride path defined by the track members, in accordance with aspects of the present disclosure.
Figure 8:
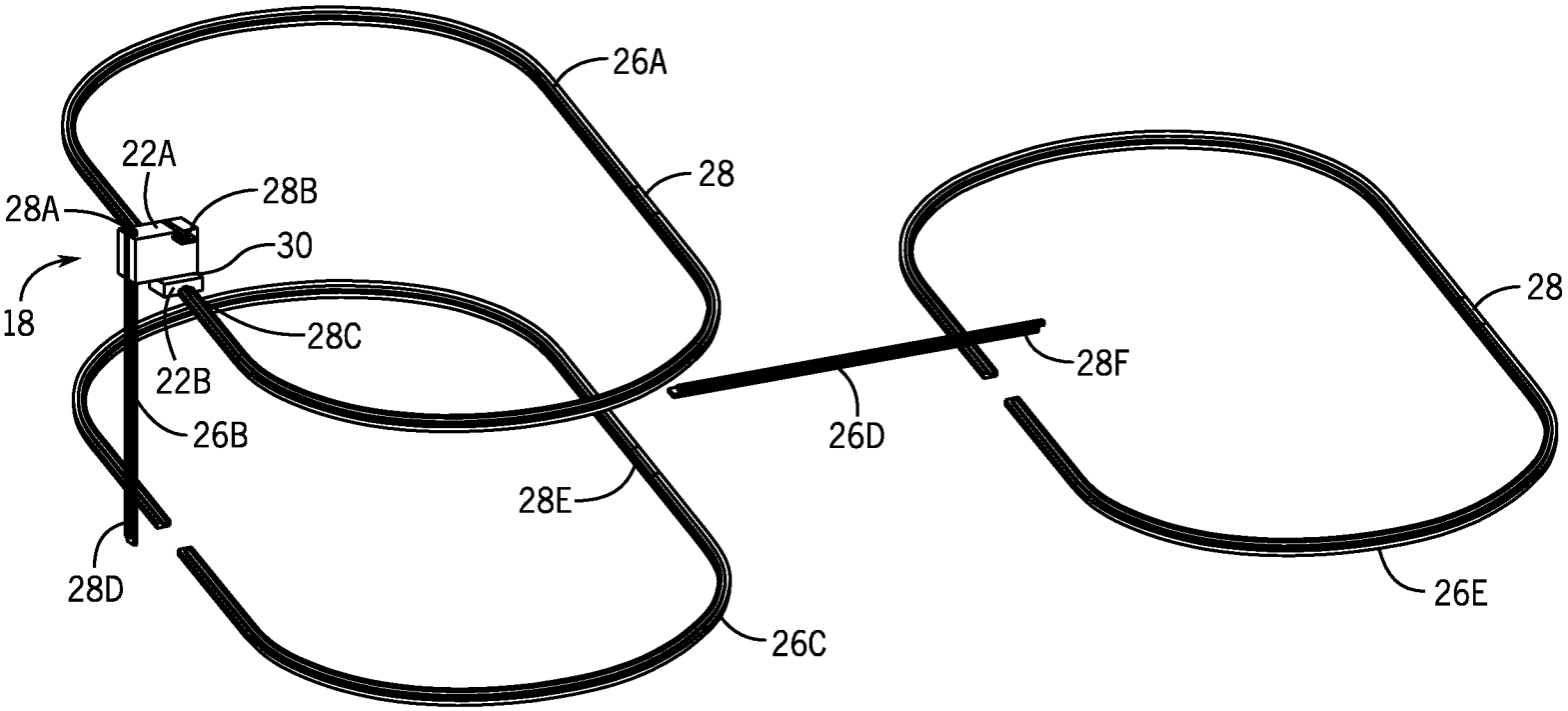

FIG. 7 illustrates the bogie system 18 traveling along a stationary track member 26A while one of the bogies 22A of the bogie system 18 is transporting two moveable track members 28A, 28B. As illustrated in FIG. 8, once the bogie system 18 aligns with a moveable track member 28C attached to the stationary track member 26A, the other bogie 22B of the bogie system 18 grips the moveable track member 28C and detaches the moveable track member 28C from the stationary track member 26A by, for example, actuating an actuation mechanism associated with the moveable track member 28C and the stationary track member 26A, as described in greater detail herein. In addition, once the bogie system 18 aligns with the moveable track member 28C attached to the stationary track member 26A, the bogie 22A of the bogie system 18 releases the moveable track member 28A and attaches the moveable track member 28A to another stationary track member 26B by, for example, actuating an actuation mechanism associated with the moveable track member 28A and the stationary track member 26B, as described in greater detail herein.

Figure 9:
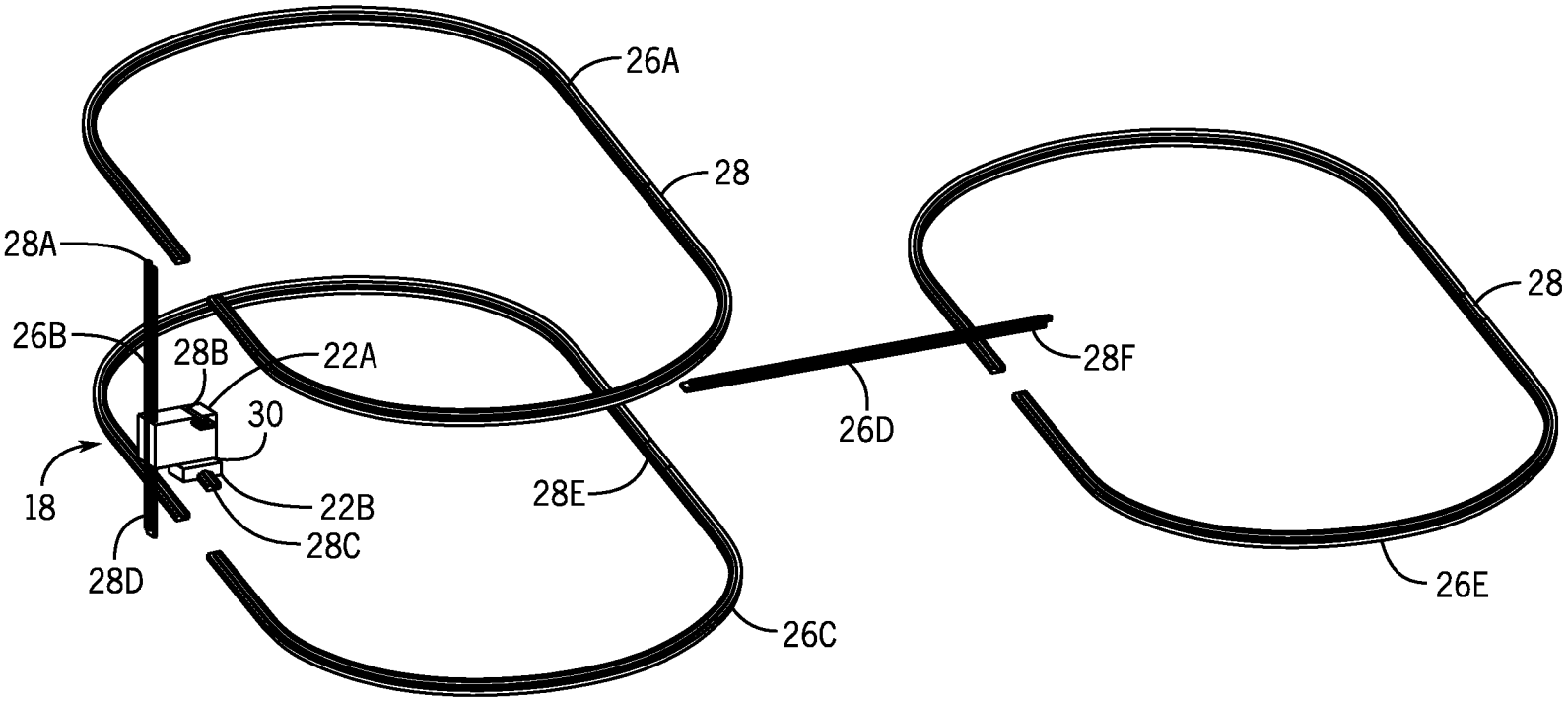
Figure 10:
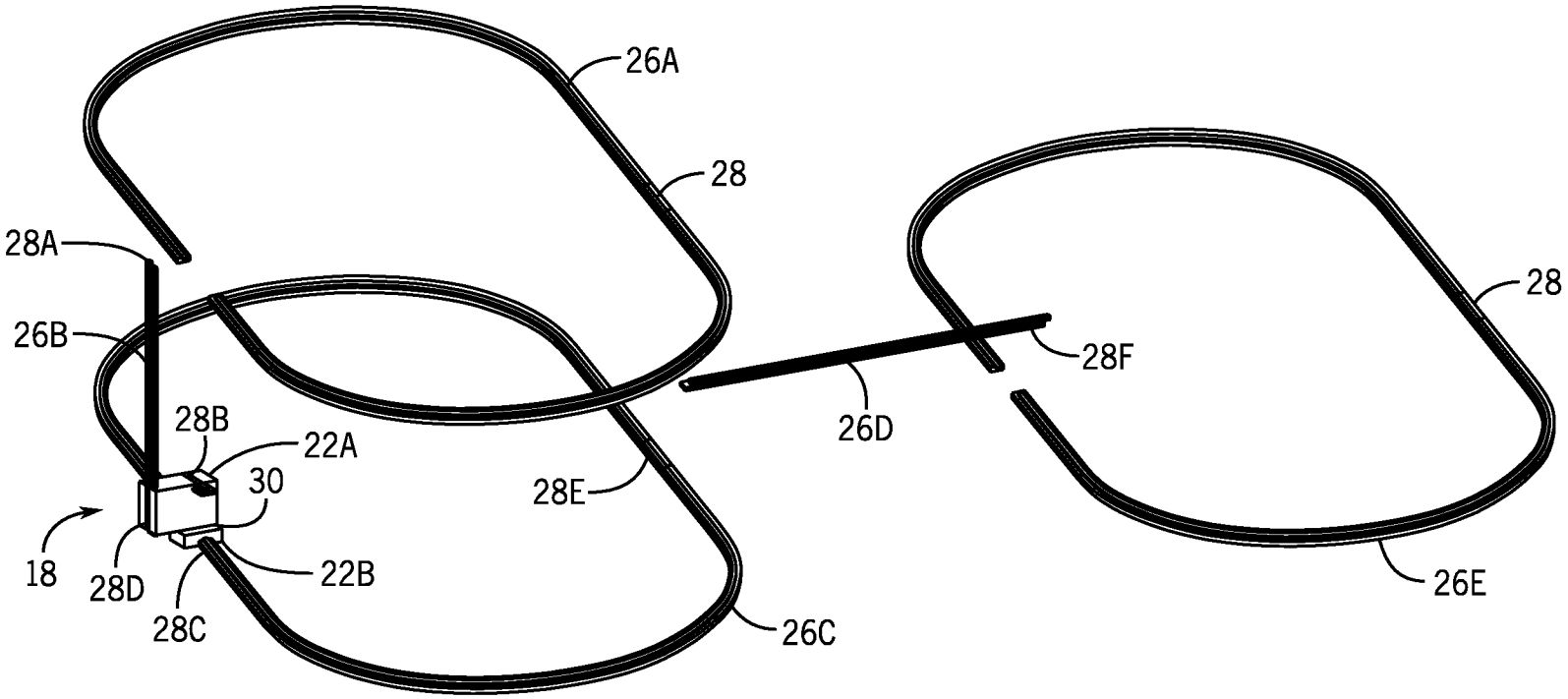

FIG. 9 illustrates the bogie system 18 traveling along the stationary track member 26B. As illustrated in FIG. 10, once the bogie system 18 aligns with a moveable track member 28D attached to the stationary track member 26B, the bogie 22A of the bogie system 18 grips the moveable track member 28D and detaches the moveable track member 28D from the stationary track member 26B by, for example, actuating an actuation mechanism associated with the moveable track member 28D and the stationary track member 26B, as described in greater detail herein. In addition, once the bogie system 18 aligns with the moveable track member 28D attached to the stationary track member 26B, the bogie 22B of the bogie system 18 releases the moveable track member 28C and attaches the moveable track member 28C to another stationary track member 26C by, for example, actuating an actuation mechanism associated with the moveable track member 28C and the stationary track member 26C, as described in greater detail herein.

Figure 11:
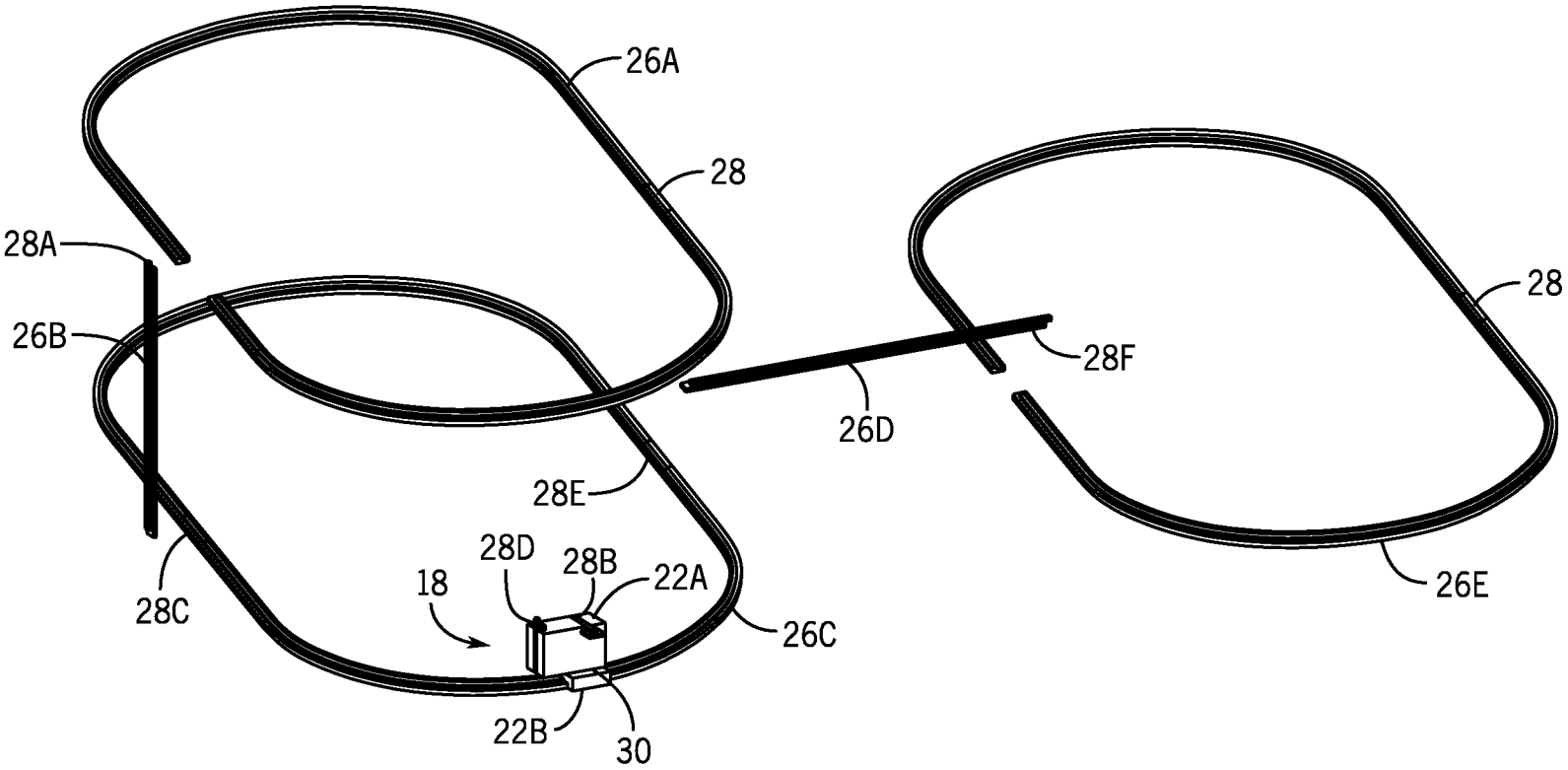
Figure 12:
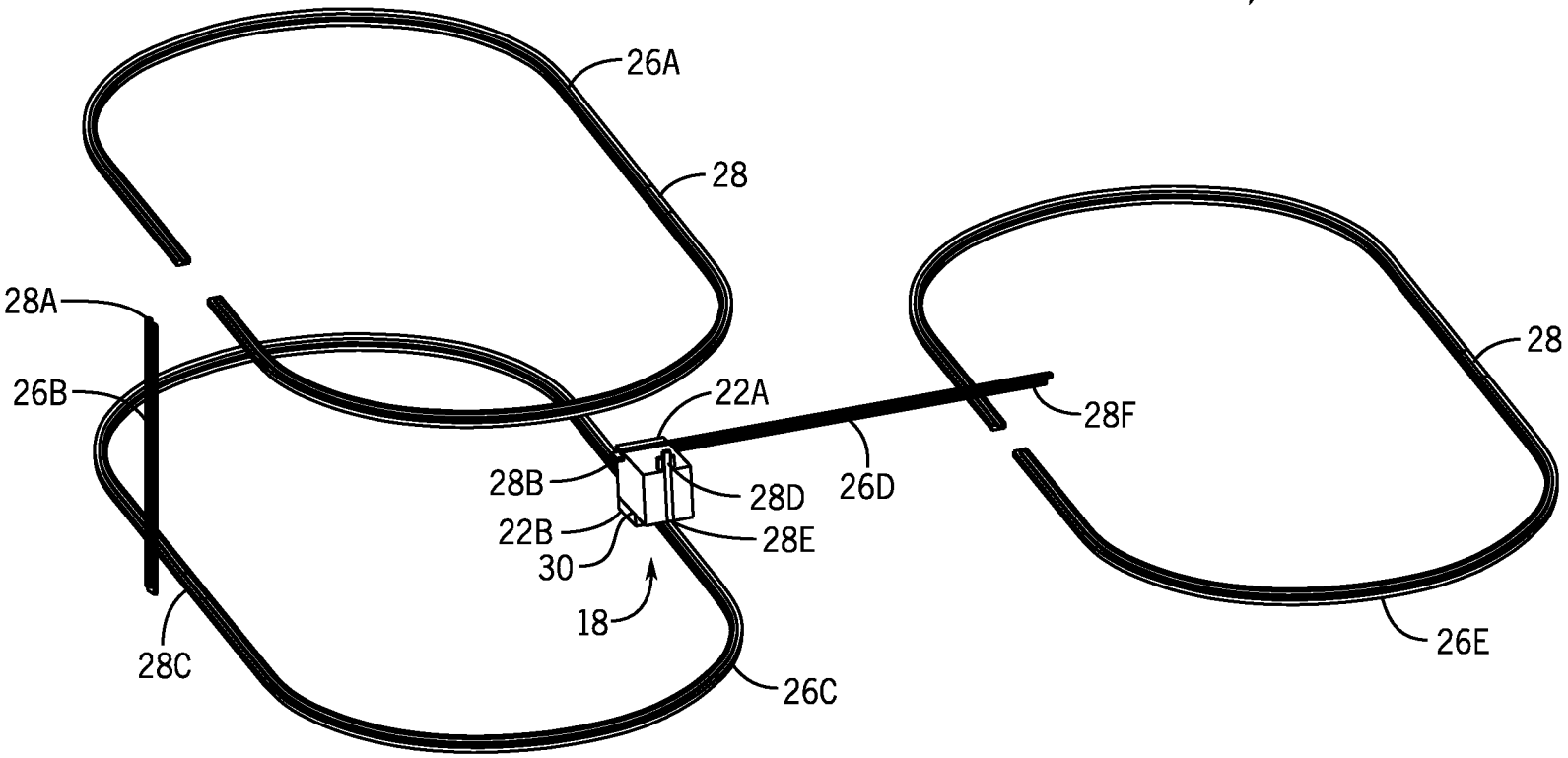

FIG. 11 illustrates the bogie system 18 traveling along the stationary track member 26C. As illustrated in FIG. 12, once the bogie system 18 aligns with a moveable track member 28E attached to the stationary track member 26C, the bogie 22B of the bogie system 18 grips the moveable track member 28E and detaches the moveable track member 28E from the stationary track member 26C by, for example, actuating an actuation mechanism associated with the moveable track member 28E and the stationary track member 26C, as described in greater detail herein. In addition, once the bogie system 18 aligns with the moveable track member 28E attached to the stationary track member 26C, the bogie 22A of the bogie system 18 releases the moveable track member 28B and attaches the moveable track member 28B to another stationary track member 26D by, for example, actuating an actuation mechanism associated with the moveable track member 28B and the stationary track member 26D, as described in greater detail herein. As illustrated in FIG. 11, as the bogie system 18 travels along the stationary track member 26C, the rotary joint 30 causes the bogie 22A to rotate relative to the bogie 22B in anticipation of the bogie system 18 interacting with the moveable track member 28E and the stationary track member 26D.

Figure 13:
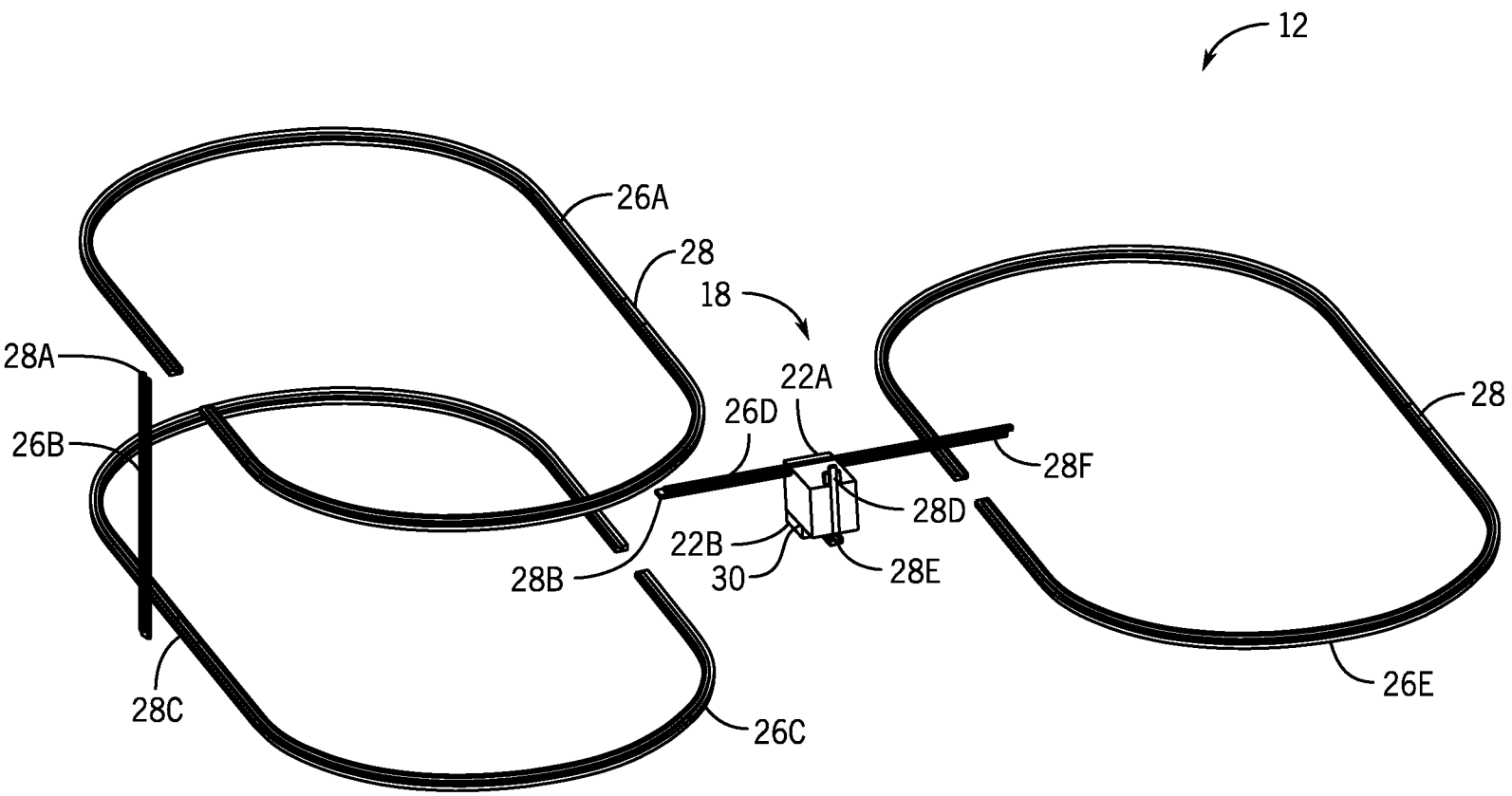
Figure 14:
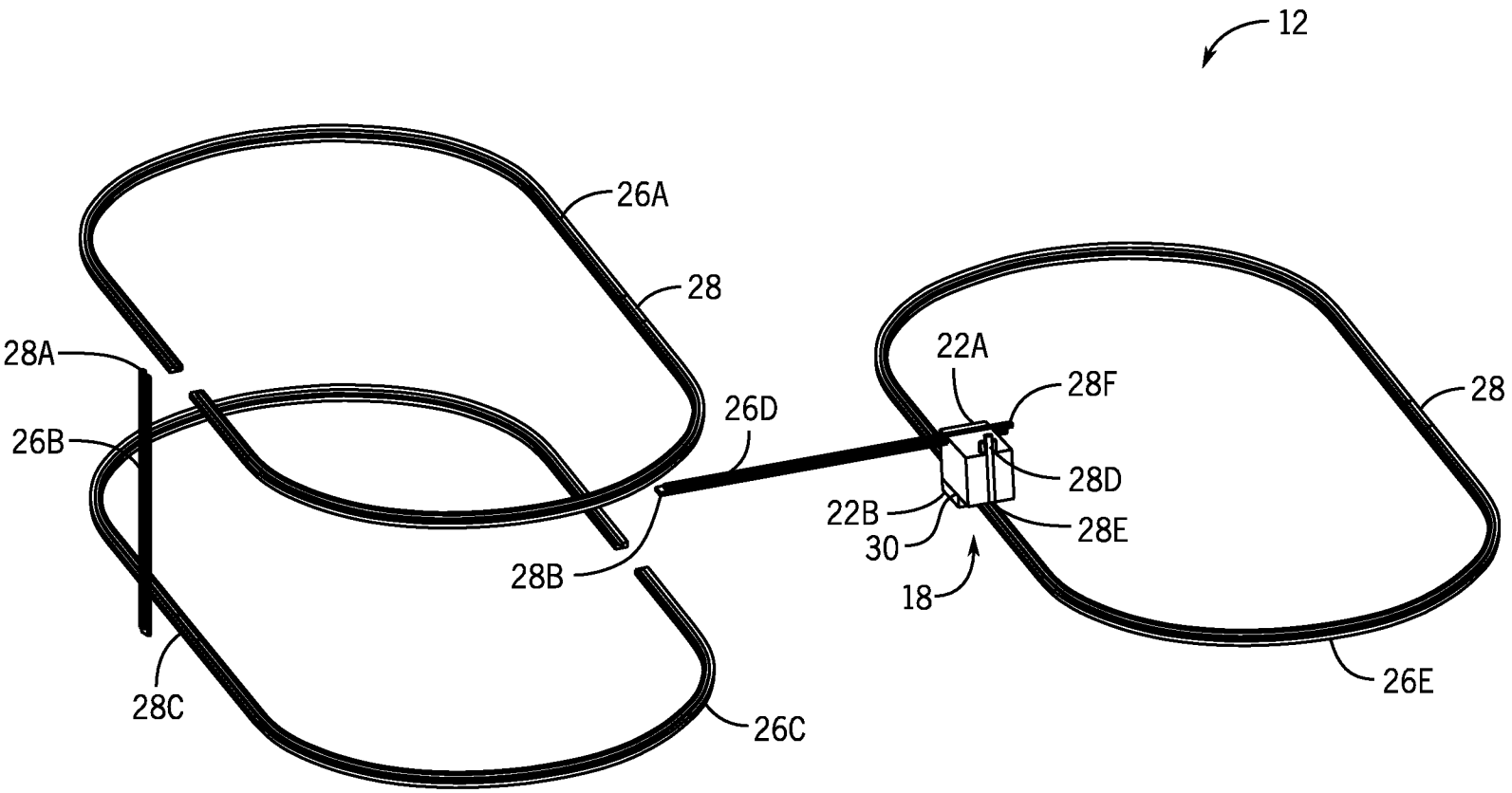

FIG. 13 illustrates the bogie system 18 traveling along the stationary track member 26D. As illustrated in FIG. 14, once the bogie system 18 aligns with a moveable track member 28F attached to the stationary track member 26D, the bogie 22A of the bogie system 18 grips the moveable track member 28F and detaches the moveable track member 28F from the stationary track member 26D by, for example, actuating an actuation mechanism associated with the moveable track member 28F and the stationary track member 26D, as described in greater detail herein. In addition, once the bogie system 18 aligns with the moveable track member 28F attached to the stationary track member 26D, the bogie 22B of the bogie system 18 releases the moveable track member 28E and attaches the moveable track member 28E to another stationary track member 26E by, for example, actuating an actuation mechanism associated with the moveable track member 28E and the stationary track member 26E, as described in greater detail herein.

As such, the bogie system 18 and the plurality of track members 26, 28 are configured to execute a "take one, leave one" method of track member switching (e.g., as illustrated in FIGS. 7 through 14) whereby the bogies 22 of the bogie system 18 carry around the moveable track members 28 as the bogie system 18 travels along a ride path 14 defined by the track members 26, 28. The moveable track members 28 fill gaps in the ride path 14 defined by the track members 26, 28 as bogie system 18 moves along the ride path 14. During switches of moveable track members 28, the bogies 22 of the bogie system 18 leave behind one moveable track member 28 and pick up another moveable track member 28. As such, the method of track member switching illustrated in FIGS. 7 through 14 utilizes coordination between the components (e.g., the bogies 22 and the rotary joint 30) of the bogie system 18, the track members 26, 28, and other components (e.g., the drive system 38, and so forth) of the ride system 12. For example, in certain embodiments, the control system 42 may coordinate control of the drive system 38, the rotary joint 30 of the bogie system 18, and the actuation mechanisms associated with the stationary track members 26 and the moveable track members 28, as described in greater detail herein.

Figure 16:
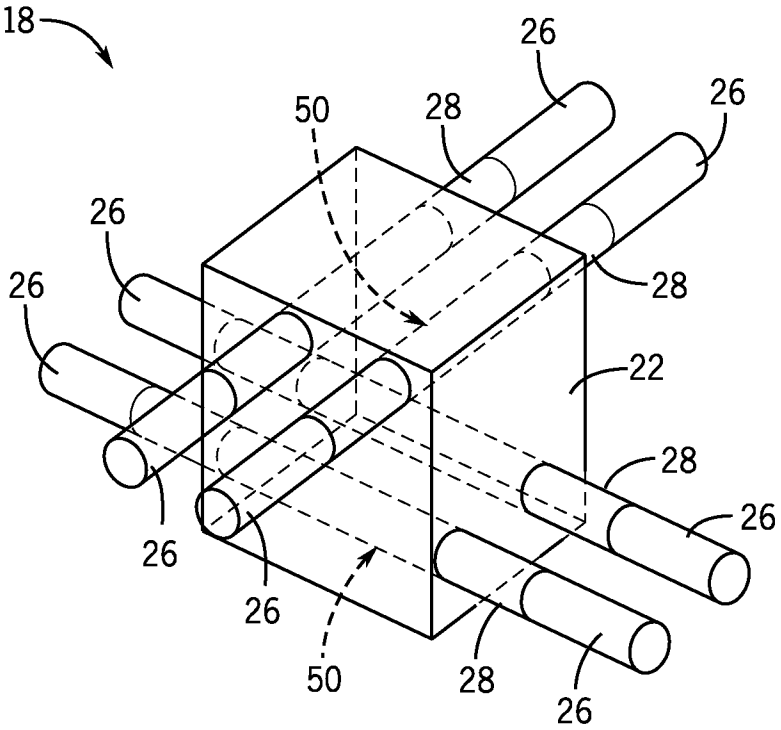
FIG. 16 is a transparent perspective view of an embodiment of a bogie system having a single bogie without a rotary joint, in accordance with aspects of the present disclosure.
Figure 15:
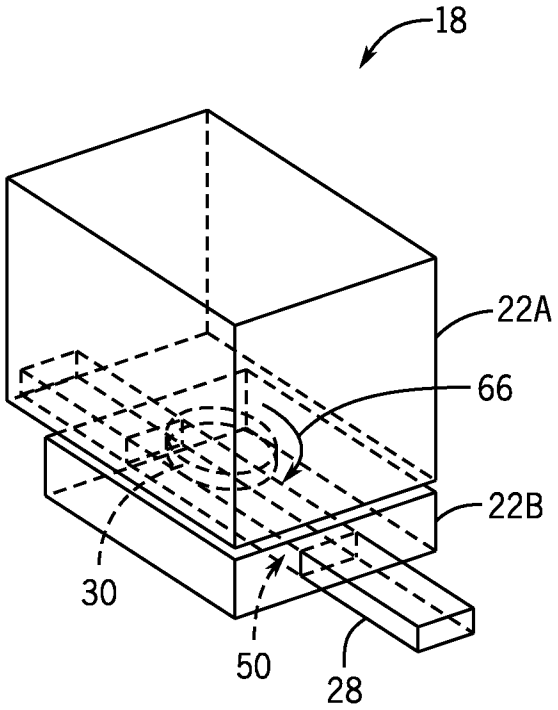
FIG. 15 is a transparent perspective view of an embodiment of a bogie system having a rotary joint coupled between two bogies, in accordance with aspects of the present disclosure.

As described herein, in certain embodiments, the bogie system 18 include a plurality of bogies 22 coupled together via a rotary joint 30 that facilitates rotation of the bogies 22 relative to each other, such that the bogies 22 may be reoriented with respect to each other for the purpose of aligning with the track members 26, 28 that define the ride path 14. For example, FIG. 15 is a transparent perspective view of an embodiment of a bogie system 18 having a rotary joint 30 coupled between two bogies 22, in accordance with aspects of the present disclosure. As illustrated in FIG. 15, the rotary joint 30 of the bogie system 18 may be configured to rotate the bogies 22 of the bogie system 18 relative to each other, as illustrated by arrow 66. As described in greater detail herein, although illustrated in FIG. 15 as having two bogies 22, in other embodiments, the bogie system 18 may instead have more than two bogies 22 with each pair of adjacent bogies 22 having a rotary joint 30 disposed between the adjacent bogies 22. Alternatively, in other embodiments, the bogie system 18 may include a single bogie 22 (i.e., without a rotary joint 30). For example, FIG. 16 is a transparent perspective view of an embodiment of a bogie system 18 having a single bogie 22 without a rotary joint 30, in accordance with aspects of the present disclosure.

Figure 17:
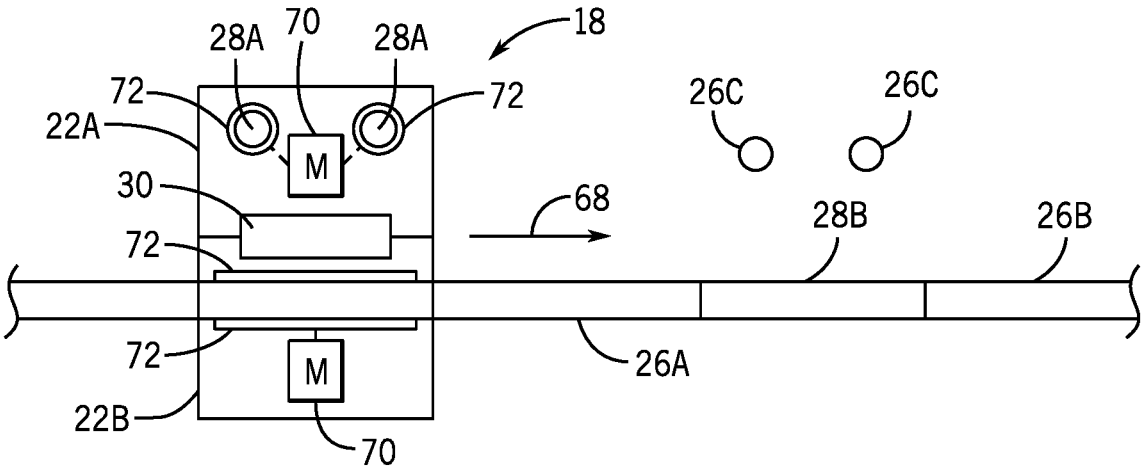
FIG. 17 is a cross sectional side view of an embodiment of a bogie system traveling along track members, in accordance with aspects of the present disclosure.

FIG. 17 is a cross sectional side view of an embodiment of a bogie system 18 traveling along track members 26, 28, in accordance with aspects of the present disclosure. As illustrated in FIG. 17, as the bogie system 18 travels along a first stationary track member 26A, as illustrated by arrow 68, the rotary joint 30 of the bogie system 18 may ensure that a first bogie 22A of the bogie system 18 that is carrying a moveable track member 28A is oriented with respect to the other bogie 22B of the bogie system 18 such that, once the bogie system 18 reaches another moveable track member 28B attached to stationary track members 26A and 26B, the moveable track member 28A being carried by the first bogie 22A may align with another stationary track member 26C such that the moveable track member 28A may be attached to the stationary track member 26C by the first bogie 22A. Then, once the other bogie 22B of the bogie system 18 detaches the moveable track member 28B from the stationary track members 26A and 26B, the bogie system 18 may begin traveling along the stationary track member 26C.

As described herein, the bogie system 18 may be configured to detach moveable track members 28 from stationary track members 26, and to attach moveable track members 28 back to other stationary track members 26. In particular, in certain embodiments, track engagement mechanisms 50 of each of the bogies 22 of the bogie system 18 may be configured to grip moveable track members 28, and to switch actuation mechanisms associated with the moveable track members 28 and the stationary track members 26 to which the moveable track members 28 are attached to and/or detached from. For example, in certain embodiments, the track engagement mechanisms 50 of the bogies 22 of the bogie system 18 may include powered motors 70 configured to actuate a gripping device 72 toward (or away from) the stationary track members 28 to provide (or release) a gripping force against the stationary track members 28.

Figure 18:
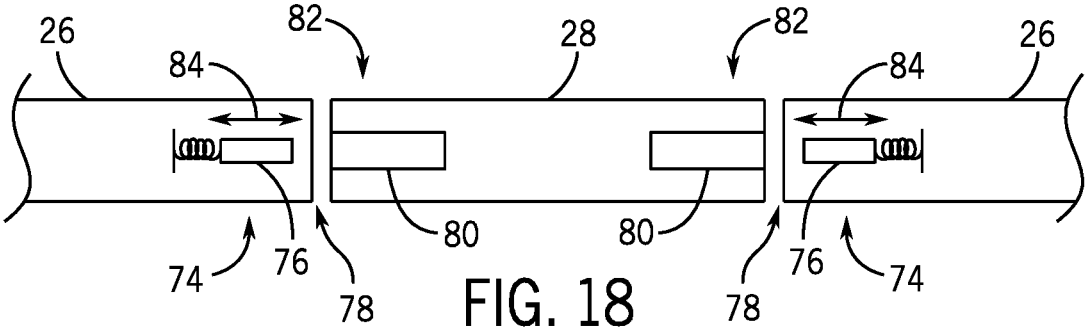
FIGS. 18 and 19 are cross sectional side views of a moveable track member and two adjacent stationary track members having actuation mechanisms configured to be switched by a bogie system to attach and/or detach the moveable track member from the stationary track members, in accordance with aspects of the present disclosure.
Figure 19:
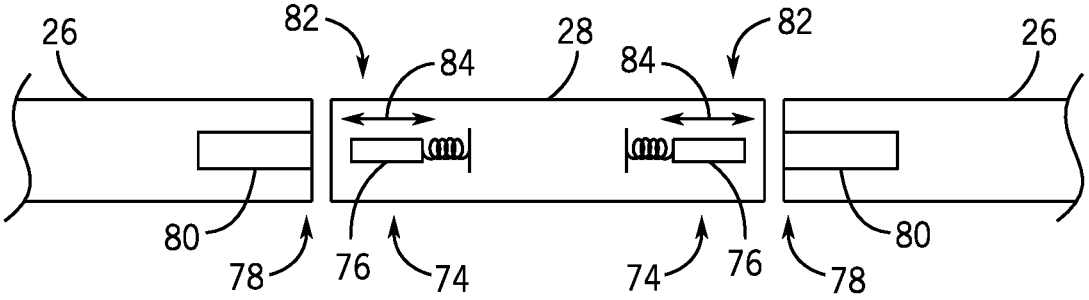

In addition, in certain embodiments, each of the bogies 22 of the bogie system 18 may be configured to switch actuation mechanisms that are disposed within (or otherwise associated with) certain track members 26, 28. FIGS. 18 and 19 are cross sectional side views of a moveable track member 28 and two adjacent stationary track members 26 having actuation mechanisms 74 configured to be switched by a bogie system 18 to attach and/or detach the moveable track member 28 from the stationary track members 26, in accordance with aspects of the present disclosure. In the embodiment illustrated in FIG. 18, the actuation mechanism 74 includes co-axial locking devices 76 disposed within the stationary track members 26 at axial ends 78 of the stationary track members 26, which are configured to be switched (e.g., by a track engagement mechanism 50 of a bogie 22 of a bogie system 18) into and out of mating bores 80 disposed at opposite axial ends 82 of the moveable track member 28, as illustrated by arrow 84. Alternatively, in the embodiment illustrated in FIG. 19, the actuation mechanism 74 includes co-axial locking devices 76 disposed within the moveable track member 28 at the opposite axial ends 82 of the moveable track member 28, which are configured to be switched (e.g., by a track engagement mechanism 50 of a bogie 22 of a bogie system 18) into and out of mating bores 80 disposed at the axial ends 78 of the stationary track members 26, as illustrated by arrow 84.

In certain embodiments, the locking devices 76 may include a gas actuated spring return device. In such an embodiment, actuation may be accomplished, for example, by filling a track member 26, 28 with gas that is then magnetically activated to actuate the spring return device. However, this embodiment is merely exemplary, and not intended to be limiting, as any suitable actuation techniques may be used for the locking devices 76 described herein.

Although primarily described herein as being actuated by an external source (e.g., external to the track members 26, 28), such as the track engagement mechanisms 50 of the bogies 22 of the bogie systems 18, in other embodiments, the locking devices 76 associated with the moveable track members 28 and adjacent stationary track members 26 may instead be actuated internally. For example, in certain embodiments, the locking devices 76 associated with the moveable track members 28 and adjacent stationary track members 26 may be actuated based solely on forces that are applied to (or removed from) the moveable track members 28 and adjacent stationary track members 26. As but one non-limiting example, when a bogie system 18 aligns with a particular moveable track member 28, forces created from the weight of the bogie system 18 (and associated ride vehicle 16, in certain embodiments) may cause internal forces within the moveable track member 28 to release a locking device 76 that otherwise holds the moveable track member 28 in place with respect to adjacent stationary track members 26.

Figure 20:
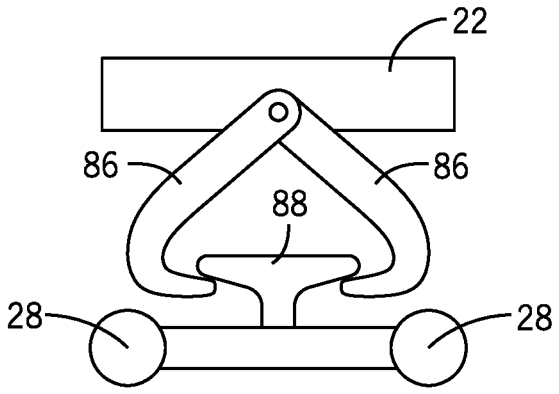
FIG. 20 is a cross sectional side view of another embodiment of an actuation mechanism for capturing a moveable track member, in accordance with aspects of the present disclosure.

The co-axial locking devices 76 illustrated in FIGS. 18 and 19 are merely exemplary of certain embodiments of an actuation mechanism 74 for attaching and/or detaching a moveable track member 28 from adjacent stationary track members 26. For example, FIG. 20 is a cross sectional side view of another embodiment of an actuation mechanism 74 for capturing a moveable track member 28, in accordance with aspects of the present disclosure. As illustrated in FIG. 20, in certain embodiments, the actuation mechanism 74 may include a set of jaws 86 configured to clamp onto a knob 88 extending from a moveable track member 28 to provide wayside or off-board locking.

Figure 21:
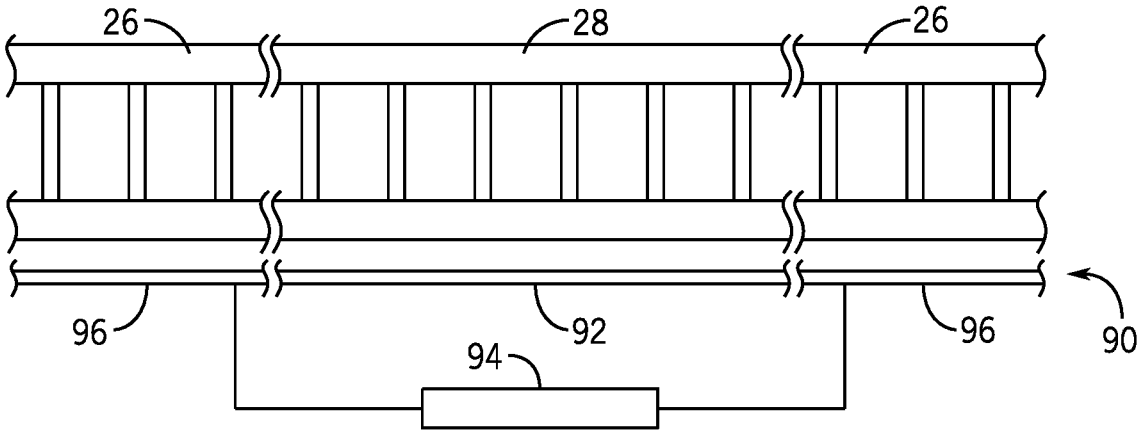
FIG. 21 illustrates an embodiment of a power transfer rail that is disposed alongside track members, in accordance with aspects of the present disclosure.

In certain embodiments, certain components (e.g., the rotary joint 30, the motor 70, and so forth) of the bogie system 18 may be powered locally, for example, by a battery or other power source within the bogie system 18. However, in other embodiments, the track members 26, 28 may be associated with a power transfer rail (e.g., bus bar) 90 that provides power to the bogie system 18. For example, FIG. 21 illustrates an embodiment of a power transfer rail 90 that is disposed alongside track members 26, 28, in accordance with aspects of the present disclosure. In certain embodiments, when the bogie system 18 aligns with the moveable track member 28, the bogie system 18 may not only detach the moveable track member 28 from adjacent stationary track members 26, but also detach a moveable section 92 of the power transfer rail 90, and then transport both the moveable track member 28 and the moveable section 92 of the power transfer rail 90 to another location, and re-attach the moveable track member 28 and the moveable section 92 of the power transfer rail 90 at that location, as described in greater detail herein. In such an embodiment, when the moveable section 92 of the power transfer rail 90 is detached by the bogie system 18, jumper boxes 94 may be used to maintain electrical contact between stationary sections 96 of the power transfer rail 90 that are left behind.

Figure 22:
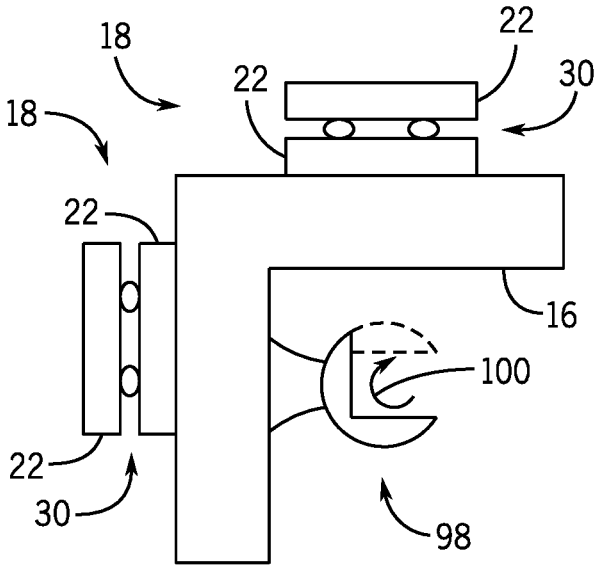
FIG. 22 is a side view of an embodiment of a ride vehicle that is coupled to multiple bogie systems, in accordance with aspects of the present disclosure.

As described herein, in certain embodiments, each bogie system 18 may be associated with a single ride vehicle 16. However, in other embodiments, a ride vehicle 16 may be coupled to multiple bogie systems 18, where one of the bogie systems 18 may currently be used to transport the ride vehicle 16 along the ride path 14 defined by the track members 26, 28, and the other bogie system 18 may be used to transport the ride vehicle 16 along other sections of the ride path 14 defined by the track members 26, 28. FIG. 22 is a side view of an embodiment of a ride vehicle 16 that is coupled to multiple bogie systems 18, in accordance with aspects of the present disclosure. As illustrated in FIG. 22, in certain embodiments, the ride vehicle 16 may include seats 98 that are configured to accommodate changing orientations of the ride vehicle 16 that may be caused by switching between the bogie systems 18. For example, in certain embodiments, the seats 98 may be configured to rotate, as illustrated by arrow 100, to reorient a passenger 20 in response to the forces of gravity, for example.

Figure 23:
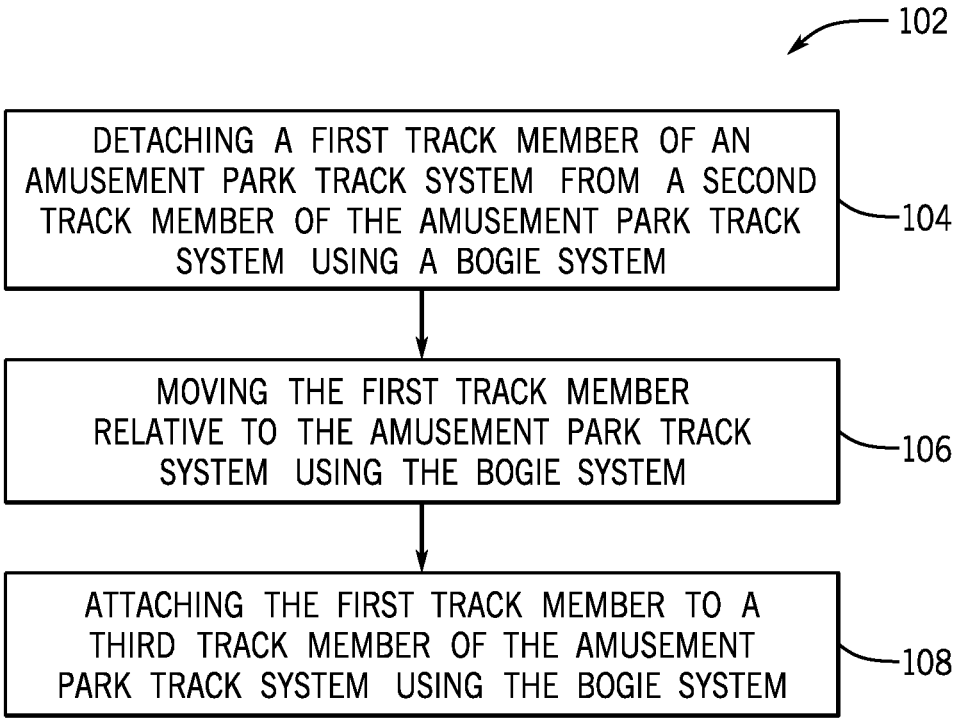
FIG. 23 is a flow diagram of a method of operation of the ride system, in accordance with aspects of the present disclosure.

As described herein, the control system 42 may be configured to control operation of the various components of the ride system 12 based at least in part on the operating parameters detected by the one or more sensor assemblies 40. For example, FIG. 23 is a flow diagram of a method 102 of operation of the ride system 12 described herein, which may be controlled by the control system 42, in accordance with aspects of the present disclosure. In certain embodiments, the method 102 may include detaching a first (e.g., moveable) track member 28 of the track system 24 from a second (e.g., stationary) track member 26 of the track system 24 using a bogie system 18 (block 104). In addition, in certain embodiments, the method 102 may include moving the first (e.g., moveable) track member 28 relative to the track system 24 using the bogie system 18 (block 106). In addition, in certain embodiments, the method 102 may include attaching the first (e.g., moveable) track member 28 to a third (e.g., stationary) track member 26 of the track system 24 using the bogie system 18 (block 108). As described herein, in certain embodiments, the control system 42 may control the various components of the ride system 12 based at least in part on, for example, the position, velocity, and/or acceleration of the ride vehicle 16 (e.g., relative to the ride path 14) as detected by the one or more sensor assemblies 40. For example, the position, velocity, and/or acceleration of the ride vehicle 16 may be used to determine a relative position, velocity, and/or acceleration of the ride vehicle 16 with respect to a particular track member 28, which may be caused by the control system 42 to be either detached or attached by the bogie system 18.

While only certain features of the disclosed embodiments have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. An apparatus of an amusement park, comprising:

a bogie system configured to be positioned on a track system comprising a plurality of track members that define a ride path, wherein the bogie system comprises one or more bogies, each bogie comprising a track engagement mechanism configured to facilitate motion of the bogie along the plurality of track members, to detach a moveable track member of the plurality of track members from a first stationary track member of the plurality of track members, to move the moveable track member to a new location along the track system, and to attach the moveable track member to a second stationary track member of the plurality of track members at the new location along the track system.

2. The apparatus of claim 1, wherein the bogie system is configured to receive and secure a ride vehicle to the bogie system.

3. The apparatus of claim 1, wherein the bogie system comprises a plurality of bogies and at least one rotary joint configured to facilitate rotation of the plurality of bogies relative to each other.

4. The apparatus of claim 1, wherein the track engagement mechanism comprises a groove disposed on a side of a bogie of the one or more bogies.

5. The apparatus of claim 1, wherein the track engagement mechanism extends through a bogie of the one or more bogies.

6. The apparatus of claim 1, wherein each bogie comprises a track member gripping mechanism configured to grip moveable track member to detach the moveable track member from the track system from the track, and to release the moveable track member to attach the moveable track member to the track system.

7. The apparatus of claim 1, wherein the bogie system comprises a plurality of bogies, and wherein the track engagement mechanism is configured to facilitate bidirectional motion of a bogie of the plurality of bogies along the plurality of track members.

8. The apparatus of claim 1, wherein each bogie is configured to switch an actuation mechanism associated with the plurality of track members to detach the moveable track member from the track system, and to attach the moveable track member to the track system.

9. An amusement park track system, comprising:

a plurality of track members that define a ride path, wherein the plurality of track members comprises:

a first set of stationary track members that remain fixed relative to the ride path; and a second set of moveable track members members, wherein each moveable track member of the second set of moveable track members is detached configured to be detached from a first stationary track member of the first set of stationary track members, to be moved to a new location along the first set of stationary track members, and to be attached to the first set of stationary track members at the new location.

10. The amusement park track system of claim 9, wherein each moveable track member of the second set of moveable track members is associated with an actuation mechanism configured to be actuated to detach the moveable track member from the first set of stationary track members, and to attach the moveable track member to the first set of stationary track members.

11. The amusement park track system of claim 9, comprising a drive system configured to cause motion of a structure along the ride path.

12. The amusement park track system of claim 11, wherein at least one track member of the plurality of track members comprises at least one sensor configured to detect a position, velocity, or acceleration of the structure with respect to the ride path.

13. The amusement park track system of claim 12, comprising a controller communicatively coupled to the sensor and configured to control the drive system based at least in part on the detected position, velocity, acceleration, or any combination thereof.

14. The amusement park track system of claim 9, wherein at least one track member of the plurality of track members comprises a stop device configured to stop motion of a structure traveling along the ride path.

15. The amusement park track system of claim 9, wherein at least one of the stationary track members of the first set of stationary track members is disconnected from other stationary track members of the first set of stationary track members.

16. A method comprising:

detaching a moveable track member of an amusement park track system from a first stationary track member of the amusement park track system using a bogie system;

moving the moveable track member to a new location along the amusement park track system using the bogie system; and attaching the moveable track member to a second stationary track member of the amusement park track system at the new location using the bogie system.

17. The method of claim 16, wherein the bogie system is configured to detach the moveable track member from the first stationary track member, and to attach the first track member to the second stationary track member by actuating at least one actuation mechanism associated with the moveable track member.

18. The method of claim 16, comprising rotating a first bogie of the bogie system relative to a second bogie of the bogie system using a rotary joint of the bogie system.

19. The method of claim 16, comprising detecting a position, velocity, or acceleration of the bogie system using at least one sensor of the amusement park track system.

20. The method of claim 19, comprising controlling operation of the bogie system based at least in part on the detected position, velocity, acceleration, or any combination thereof.

* * * * *